US010174519B1

(12) United States Patent
Carpenter et al.

(10) Patent No.: US 10,174,519 B1
(45) Date of Patent: Jan. 8, 2019

(54) APPARATUS TO WIRELESSLY MONITOR A STATUS OF A HATCH

(71) Applicant: Emerson Process Management Regulator Technologies Tulsa, LLC, Tulsa, OK (US)

(72) Inventors: Scott Lee Carpenter, New Albany, IN (US); Travis Ellison, Tulsa, OK (US)

(73) Assignee: Emerson Process Management Regulator Technologies Tulsa, LLC, Tulsa, OK (US)

( * ) Notice: Subject to any disclaimer, the term of this patent is extended or adjusted under 35 U.S.C. 154(b) by 0 days.

(21) Appl. No.: 15/676,616

(22) Filed: Aug. 14, 2017

(51) Int. Cl.

| | |
|---|---|
| ***G08B 1/08*** | (2006.01) |
| ***E05B 17/22*** | (2006.01) |
| ***E05B 65/00*** | (2006.01) |
| ***E05C 19/10*** | (2006.01) |
| ***G08B 21/18*** | (2006.01) |

(52) U.S. Cl.
CPC ..... *E05B 17/22* (2013.01); *E05B 65/001* (2013.01); *E05C 19/10* (2013.01); *G08B 21/18* (2013.01); *E05Y 2900/602* (2013.01)

(58) Field of Classification Search
CPC ..... E05B 17/22; E05B 65/001; E05C 19/10; G08B 21/18; E05Y 2900/602
See application file for complete search history.

(56) References Cited

U.S. PATENT DOCUMENTS

| | | | | |
|---|---|---|---|---|
| 4,423,909 | A * | 1/1984 | Page | B60T 8/185 303/22.2 |
| 4,700,609 | A * | 10/1987 | Wiethoff | F41A 9/16 89/46 |
| 4,823,676 | A * | 4/1989 | Wiethoff | F41A 9/16 89/33.14 |
| 9,161,621 | B1 * | 10/2015 | Huffin | A47B 81/00 |
| 9,617,071 | B2 * | 4/2017 | Lorenzen | B65D 90/48 |
| 9,764,893 | B1 * | 9/2017 | Westmoreland, III | B65D 90/22 |
| 2002/0190068 | A1 * | 12/2002 | Sisk | B65D 90/10 220/263 |
| 2006/0226942 | A1 * | 10/2006 | Dimig | B60R 25/02 335/220 |
| 2010/0200307 | A1 * | 8/2010 | Toms | G01G 19/042 177/163 |
| 2013/0062893 | A1 * | 3/2013 | McLaughlin | E05B 51/02 292/256.6 |

(Continued)

FOREIGN PATENT DOCUMENTS

| | | |
|---|---|---|
| WO | 2012079746 | 6/2012 |
| WO | 2013152282 | 10/2013 |
| WO | 2015113021 | 7/2015 |

OTHER PUBLICATIONS

International Searching Authority, "Invitation to Pay Additional Fees and, Where Applicable, Protest Fee," issued in connection with International Patent Application PCT/US2018/043710, dated Sep. 17, 2018, 6 pages.

*Primary Examiner* — Joseph Feild
*Assistant Examiner* — Rufus Point
(74) *Attorney, Agent, or Firm* — Hanley, Flight & Zimmerman, LLC

(57) ABSTRACT

Apparatus to wirelessly monitor a position of a hatch are disclosed. An example apparatus includes a hatch to be coupled to a fluid tank, a latch to secure the hatch in a closed position, and a sensor to detect whether the latch is securing the hatch in a closed position.

22 Claims, 5 Drawing Sheets

(56) References Cited

U.S. PATENT DOCUMENTS

| | | | | |
|---|---|---|---|---|
| 2013/0264341 | A1* | 10/2013 | Cockerham | B65D 90/105<br>220/203.29 |
| 2016/0001935 | A1* | 1/2016 | Smith | B65D 90/10<br>29/428 |
| 2016/0253894 | A1* | 9/2016 | Pignolet | G08B 21/18<br>49/13 |
| 2016/0284193 | A1* | 9/2016 | Davis | G01M 3/16 |
| 2016/0288994 | A1* | 10/2016 | Lorenzen | B65D 90/48 |
| 2017/0138498 | A1 | 5/2017 | Kayser | |
| 2017/0321452 | A1* | 11/2017 | Whiting | E04B 7/16 |

* cited by examiner

APPARATUS TO WIRELESSLY MONITOR A STATUS OF A HATCH

FIELD OF THE DISCLOSURE

This disclosure relates generally to hatches, and, more particularly, to apparatus to wirelessly monitor a position of a hatch.

BACKGROUND

Industries that process liquids and gases often store the liquids and gasses in low pressure liquid storage tanks. The tanks may include hatches mounted to the top of the tank to allow access to the tank contents for visual inspection and measurement of the fluid using various instruments. During inspection of the contents of the tank, the hatch is opened. In some examples, the hatch is operative to regulate a pressure in the tank and may briefly open to maintain a designated pressure of the tank. At all other times, the hatch is typically closed to prevent the fluid in the tank from excessively venting to the atmosphere. Typically, hatches include latches and/or seals to ensure that the contents of the tank are not venting when the hatch is properly closed.

SUMMARY

An example apparatus includes a hatch to be coupled to a fluid tank, a latch to secure the hatch in a closed position, and a sensor to detect whether the latch is securing the hatch in a closed position.

Another example apparatus includes means for securing a means for closing a tank and means for detecting a position of the means for securing.

Another example apparatus includes a hook to engage a catch on a hatch of a tank, a first portion of a sensor coupled to the hook, an adapter plate positioned adjacent to the hook, and a second portion of the sensor coupled to the adapter plate.

Figure 1:
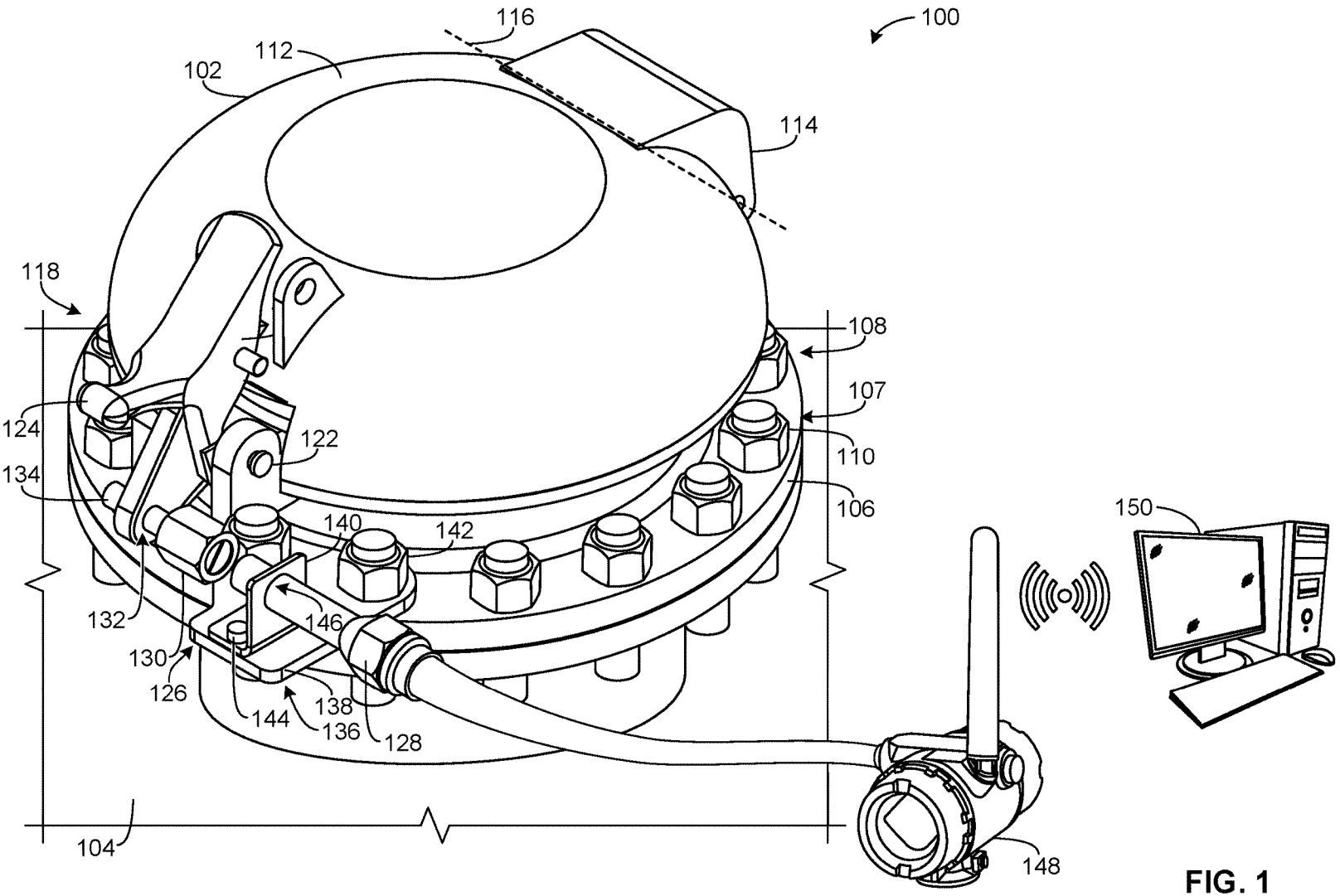
FIG. 1 depicts an example apparatus as described herein.

The figures are not to scale. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts. As used herein, the terms hatch and thief hatch may be used interchangeably.

DETAILED DESCRIPTION

Typically, hatches on low pressure fluid storage tanks are closed unless the contents of the tank are being inspected.

When closed, the hatches are designed to accommodate for pressure changes within the tank due to atmospheric changes, filling, and/or draining of the tank. In some examples, the hatch is designed to vent gases by temporarily breaking a seal when the pressure of the tank is outside a designated range. If not properly closed, the hatch may vent excess gases from the tank to the atmosphere, which may lead to environmental concerns, fines, and/or loss of product. Additionally, the hatch may be designed to temporarily break a seal to introduce gases from the atmosphere to relieve negative pressure (e.g., vacuum pressure). The pressure and vacuum relief functions of the hatch cannot function correctly if the hatch is not properly closed, which may cause the contents of the tank to be held at an improper pressure. Thus, it is beneficial for an operator to know the state of the hatch to prevent unwanted and/or unnecessary flow of gases into or out of the tank.

Current hatches do not include an indicator or sensor to alert the operator of the status (e.g., open, closed) of the hatch (e.g., a lid of the hatch). Providing an indication of the hatch status to the operator can reduce unwanted or unnecessary venting arising from an improperly closed hatch lid. If the operator is alerted that the status of the hatch is open (e.g., a lid of the hatch is open or at least not properly closed), the operator can evaluate whether the hatch is open due to an inspection of the contents of the tank or whether the hatch (e.g., the lid of the hatch) was inadvertently left open and needs to be properly closed. If the hatch needs to be properly closed, the operator can take the appropriate actions to properly close the hatch and reduce unwanted venting. In the examples herein, the lid may be considered open when the latch is not in a secure position, and the lid may be considered closed when the latch is in a secure position (e.g., a locking position).

The apparatus described herein enables an operator to wirelessly monitor a status (e.g., a position) of a hatch of a fluid tank. A sensor coupled to the example hatch is operative to detect whether the hatch is properly closed. A transmitter is coupled to the sensor to provide the status of the hatch to an operator workstation via a wireless signal. When the hatch is properly closed, the sensor may communicate a first signal to the operator workstation via the transmitter to indicate to the operator the closed status of the hatch. If the hatch is not properly closed, the sensor may communicate a second signal to the operator workstation via the transmitter. Upon receiving the second signal, the operator workstation may provide an alert (e.g., an alarm) to the operator to indicate the hatch is not properly closed. The operator may then take proper action to determine whether the contents of the tank are being inspected or the hatch needs to be closed.

The example hatch may be a thief hatch coupled to a top of the fluid tank. Alternatively, any other hatch suitable for a fluid tank may be used. The hatch may be coupled to the tank via a base portion and a movable portion may be rotatable relative to the base portion to allow access to the tank. The example latch mechanism may include a hook coupled to the movable portion of the hatch. When in the closed position, the hook engages a catch coupled to the base portion of the hatch. An adapter plate is positioned adjacent the hook and is coupled to the base portion of the hatch or to the tank.

In some examples, the sensor may be a proximity type sensor and may include a first portion and a second portion. Alternatively, the sensor may be another type of sensor operative to detect the status of the hatch. The first portion of the sensor may be operatively coupled to the hook, and the second portion of the sensor coupled to the adapter plate. In some examples, the first portion or the second portion of the sensor may be an integrated component of the latch or hatch. In some examples, the first portion of the sensor is a target magnet and the second portion of the sensor is a magnetic switch. When the hatch is properly closed, the first and second portions of the sensor are aligned along a longitudinal axis of the sensor. When the hatch is not closed properly (e.g., is open) the first and second portions of the sensor are misaligned and an alert may be sent to an operator workstation.

FIG. 1 depicts an example apparatus 100 as described herein. The illustrated example apparatus includes a hatch 102 of a tank 104. The example hatch 102 is designed for low pressure fluid tanks and is operative to seal the contents of the tank 104 from the atmosphere. The hatch 102 may be a thief hatch, or may be any other type of hatch suitable for fluid tanks 104 or other such vessels. The illustrated example hatch 102 includes a base portion 106 having a flange 107 with bores 108 to attach the hatch 102 to a fluid tank 104. Fasteners 110 (e.g., nuts and bolts) may be disposed through each of the bores 108 to securely couple the hatch 102 to the tank 104 and create a seal between the base 106 and the tank 104. After the base 106 is attached to the tank 104, the base 106 is fixed and not movable without removing the fasteners 110 securing the base 106 of the hatch 102 to the tank 104.

The hatch 102 includes a lid portion 112 (e.g., a movable portion) to enable the hatch 102 to be opened for inspection and/or pressure regulation. The lid portion 112 is an example means for closing the tank 104. The lid 112 of the hatch 102 is operatively coupled to the base 106 portion via a hinge 114 and may be movable from an open position to a closed position. The hinge 114 is operative to enable the lid portion 112 of the hatch 102 to rotate about an axis 116 of the hinge 114 relative to the base 106 of the hatch 102. The lid 112 may be easily opened by a user to enable the hatch 102 to be opened for inspection of the contents of the tank 104. For example, the user may take samples of the contents in the tank 104.

In some examples, the hatch 102 may be operative to slightly open (e.g., temporarily break a seal) to regulate a pressure of the tank 104 to keep the pressure within a designated range. In some examples, the lid 112 may include a venting portion (e.g., a seal) designed to open (e.g., break) and close (e.g., reseal) automatically to regulate the pressure within the tank 104. For example, the hatch 102 may vent gasses when the pressure of the tank 104 is outside of a designated threshold by temporarily breaking a seal within the hatch 102 while the lid 112 remains closed. When the pressure is within the designated range, the seal (e.g., a seal 432 of FIGS. 4-5) is operative to fluidly isolate the tank 104 from the atmosphere. In some examples, if the lid 112 is not properly closed, the hatch 102 may enable gases to vent from the tank 104, which may affect the pressure of the tank 104 and/or disrupt the pressure regulation function of the hatch 102. Excess and/or unwanted venting of the tank 104 may lead to environmental concerns or fines, and may also cause the product within the tank 104 to be stored at an improper pressure. In some cases, excess venting of the tank 104 may lead to loss of product due to, for example, evaporation because the hatch 102 is not closed properly.

To secure the hatch 102 in the properly closed position, a latch 118 is coupled to the hatch 102. The example latch 118 may easily be operated by a user to allow the user to open the hatch 102 for inspection. The example latch is an example means for securing the lid 112 of the tank 104. The example latch 118 is positioned on the hatch 102 opposite the hinge 114. The example latch 118 includes a hook portion 120 coupled to the lid 112 of the hatch 102. The hook 120 interacts with a catch 122 coupled to the base of the hatch 102. Alternatively, the hook 120 may be coupled to the base 106 of the hatch 102 and the catch 122 may be coupled to the lid 112. The hook 120 and the catch 122 are urged into engagement based on a spring force generated by a biasing element (e.g., a spring) coupled to the inside of the lid 112. The hook 120 may include a hand grip 124 (e.g., a hand hold, a handle) to enable a user or operator to easily lift and/or unlatch the hook 120 from the catch 122 after pressing down on the lid 112 to overcome the spring force. The spring force also urges a seal (e.g., the seal 432 of FIGS. 4-5) within the lid 112 against the base 106.

In the illustrated example, a sensor 126 is a proximity type sensor including a switch 128 (e.g., a Topworx Model 73 GO™ Switch) and a corresponding target 130 (e.g., a target magnet). In some examples, the target 130 may be integrated and/or correspond to a portion of the latch. The sensor 126 is an example means for detecting a position of the latch 118. The sensor 126 is operative to determine when the hatch 102 is properly closed (e.g., the latch 118 is in a secure position, the hook 120 is engaged by the catch 122) based on the proximity of the target 130 to the switch 128. The example switch 128 and target 130 of the sensor 126 are coupled to the base 106 and the lid 112 of the hatch 102, respectively. Alternatively, the switch 128 may be coupled to the lid 112 and the target 130 may be coupled to the base 106. In some examples, other types of sensors may be used, and each portion may be coupled to one of the lid 112 or the base 106. In some examples, a portion of the sensor 126 may be coupled to the tank 104 rather than the base 106 of the hatch 102. In such examples, the sensor 126 may be a limit switch, an optical sensor, etc. Alternatively, other types of sensors 126 may be used and/or the sensor 126 may only need to be coupled to either the lid 112 or the base 106. In some such examples, the sensor 126 may be coupled to the tank 104 instead of the hatch 102. For example, an acoustic emissions sensor operative to detect leaking gases (e.g., detect the sound made by the leaking gases) may be coupled to the lid 112 or to the base 106 of the hatch 102, or to the tank 104 adjacent to the hatch 102.

In the illustrated example, the switch 128 may be in an on position when the target 130 is in proximity to the switch 128 and may be in an off position when the target 130 is not in proximity to the switch 128. For example, when the target 130 is proximate to the switch 128, an operator may receive an indication that the hatch 102 is closed properly (e.g., a status indicator for the hatch 102 may indicate the hatch 102 is properly closed). When the target 130 is not proximate to the switch 128, the operator may receive an alert that the hatch 102 is not properly closed. In the illustrated examples, the target 130 is in proximity to the switch 128 when the target 130 and the switch 128 are aligned. In other examples, the position of the target 130 relative to the switch 128 that is sufficient to operate the switch 128 (e.g., is considered to be in proximity) may vary based on the target 130 and the switch 128 used.

In the illustrated example, the target 130 is coupled to the latch 118 via a bore 132 of the hook 120. A stem 134 of the target 130 may be disposed through the bore 132 of the hook 120. Alternatively, the target 130 may be coupled to the lid 112 of the hatch 102 independent of the latch 118. The switch 128 of the sensor 126 is coupled to the base 106 of the hatch 102 via a bracket 136. The bracket 136 may include an adapter plate 138 and an L-shaped bracket 140. The example adapter plate 138 is coupled to the base 106 of the hatch 102 using fasteners 142 to secure the position of the adapter plate 138 and maintain proper alignment or calibration of the sensor 126. In the illustrated example, the adapter plate 138 is coupled to the flange 107 of the base 106 using two fasteners 142 disposed through existing bores 108 in the base 106 of the hatch 102. Thus, the adapter plate 138 may be added to existing hatches 102. In other examples, a different number of fasteners 142 may be used and/or the adapter plate 138 may be attached to the base 106 of the hatch 102 using different or additional bores. The example L-shaped bracket 140 is coupled to the adapter plate 138 using additional fasteners 144. The L-shaped bracket 140 includes a bore 146 through which the switch 128 of the sensor 126 is disposed. In the illustrated example the L-shaped bracket 140 is coupled to the platform using two fasteners 144, but any other number of fasteners may be used instead. In other examples, the bracket 136 is a unitary component with the functions of the adapter plate 138 and the L-shaped bracket 140 being integrally formed.

The example switch 128 and target 130 are positioned such that the switch 128 is turned on when the lid 112 is properly closed (e.g., when the latch 118 is properly closed) and turned off when the lid 112 and/or the latch 118 are not properly closed. Alternatively, the switch 128 may be configured such that the switch 128 is on when the target 130 is not in proximity, and turned off when the target 130 is in proximity.

The example switch 128 of the sensor 126 is operatively (e.g., communicatively) coupled to a transmitter 148. The transmitter 148 is an example means for communicating. The transmitter 148 of the illustrated example is a wireless transmitter (e.g., a Rosemount 702 Transmitter). When the example sensor 126 is coupled to the hatch 102, the example sensor 126 is operative to relay a status of the hatch 102 to the operator via the transmitter 148. The transmitter 148 relays a signal (e.g., an output) from the sensor 126 to an operator workstation 150. The transmitter 148 is operative to communicate wirelessly (e.g., via a wireless field network) with the operator workstation 150. Alternatively, the transmitter 148 may use any other means of communication to communicate with the operator workstation 150. In some examples, the transmitter 148 may be mounted to the lid 112 or the base 106 of the hatch 102. Alternatively, the transmitter 148 may be mounted to the tank 104.

The example operator workstation 150 is operative to receive the signal from the sensor 126 via the transmitter 148. The operator workstation 150 is an example means for monitoring the signal from the transmitter 148. In some examples, the operator workstation 150 receives the signal indirectly via, for example, a controller. The signal indicates whether the lid 112 and/or the latch 118 are properly shut. For example, the signal may be an on/off signal from the switch 128. The signal may be on when the lid 112 is properly closed and may be off when the lid 112 is not properly closed. The operator workstation 150 is operative to provide an alert or indication to the operator based on the signal from the sensor 126. In some examples, the hatch 102 may be opened by a user or an operator to, for example, inspect the contents of the tank 104, collect samples from the tank 104, etc. In some such examples, the user or operator inspecting the tank 104 may not properly close the hatch 102, which can cause gases from the tank 104 to leak to the atmosphere. The example apparatus 100 described herein provides an alert to the operator workstation 150 when the hatch 102 is not closed properly. In some examples, an alert may not be provided unless the lid 112 and/or the latch 118 is not properly closed. In some examples, such as when the sensor is an acoustic sensor, the alert may not be provided to the operator workstation unless a designated amount of time (e.g., 30 seconds, 1 minute, 5 minutes, etc.) has passed to avoid false alerts due to the hatch 102 venting the tank 104. In other examples, an indication of the status of the hatch 102 may be available to the operator if the operator wishes to view the status of the hatch 102 at any time. In some examples, the hatch 102 may be operative to slightly open (e.g., the seal may temporarily break) to vent gas for pressure regulation purposes. If the example sensor is operative to detect fluid venting from the hatch (e.g., based on acoustic changes), the illustrated example sensor 126 and transmitter 148 described herein may be operative to alert the operator workstation 150 when the hatch 102 is venting.

The illustrated example latch 118 may be operative to be coupled to existing tanks 104 and hatches 102. That is, the sensor 126 operative to detect the status of the hatch 102 and/or secure the hatch 102 in a properly closed position may be retrofitted to hatches 102 currently used in process control systems by coupling the sensor 126 to the hatch 102 using the example bracket 136 described herein. In the illustrated example, the latch 118 (e.g., the hook 120, the catch 122) is shaped such that the hook 120 described herein can replace a hook used with current hatches 102. The catch 122 may be the same as the catches 122 currently used. Additionally, the bracket 136 (e.g., the adapter plate 138, the L-shaped bracket 140) and the transmitter 148 may be easily added to existing hatches 102 using the current bores 108 of the base 106 used to couple the hatch 102 to the tank 104 and additional fasteners 142 to secure the bracket 136 to the base 106. Alternatively, in some examples, the apparatus 100 described herein may be integrated into the hatch 102 at the time of manufacture.

Figure 2:
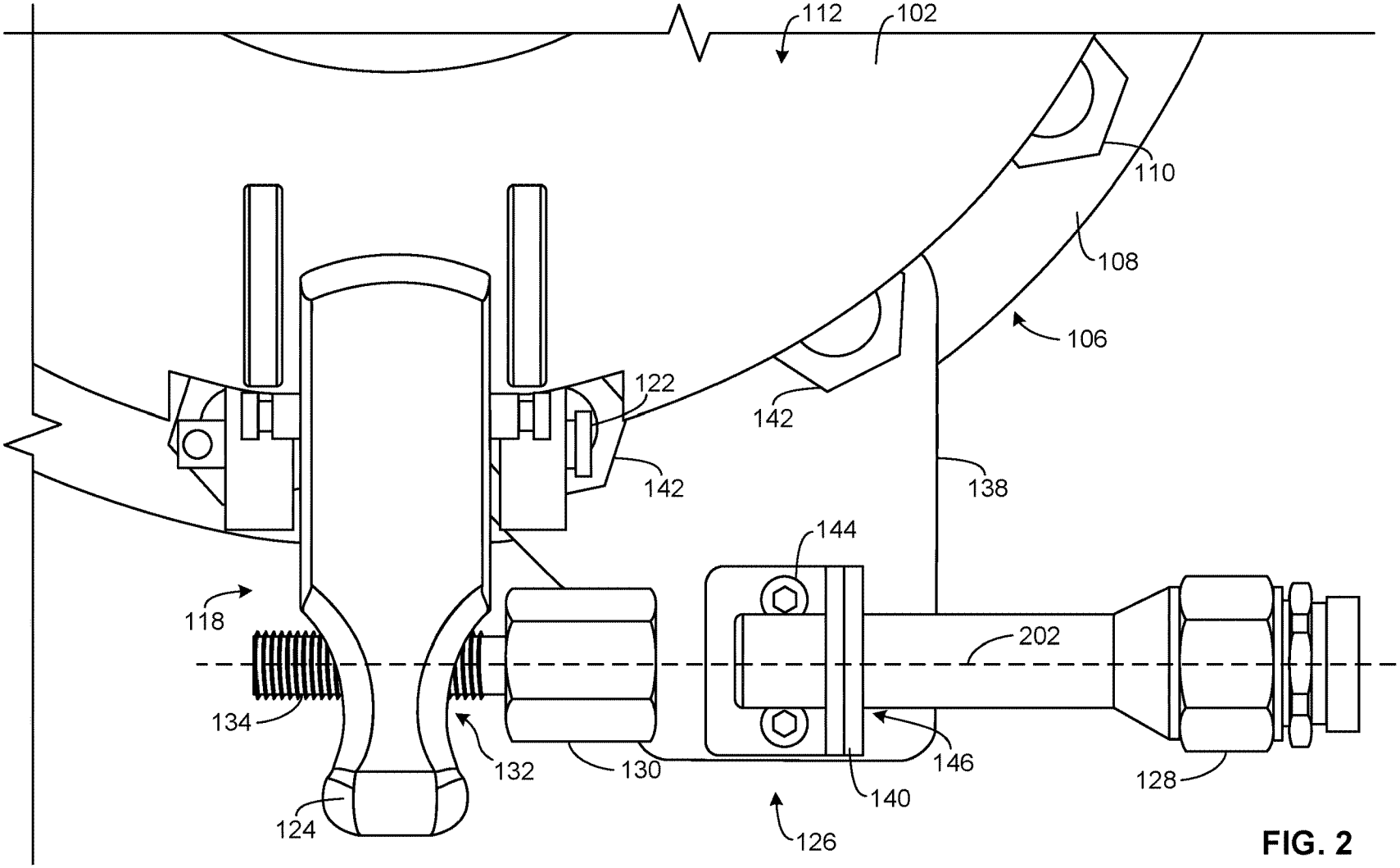
FIG. 2 is a top view of an example sensor that may be used to implement the example apparatus of FIG. 1.
Figure 3:
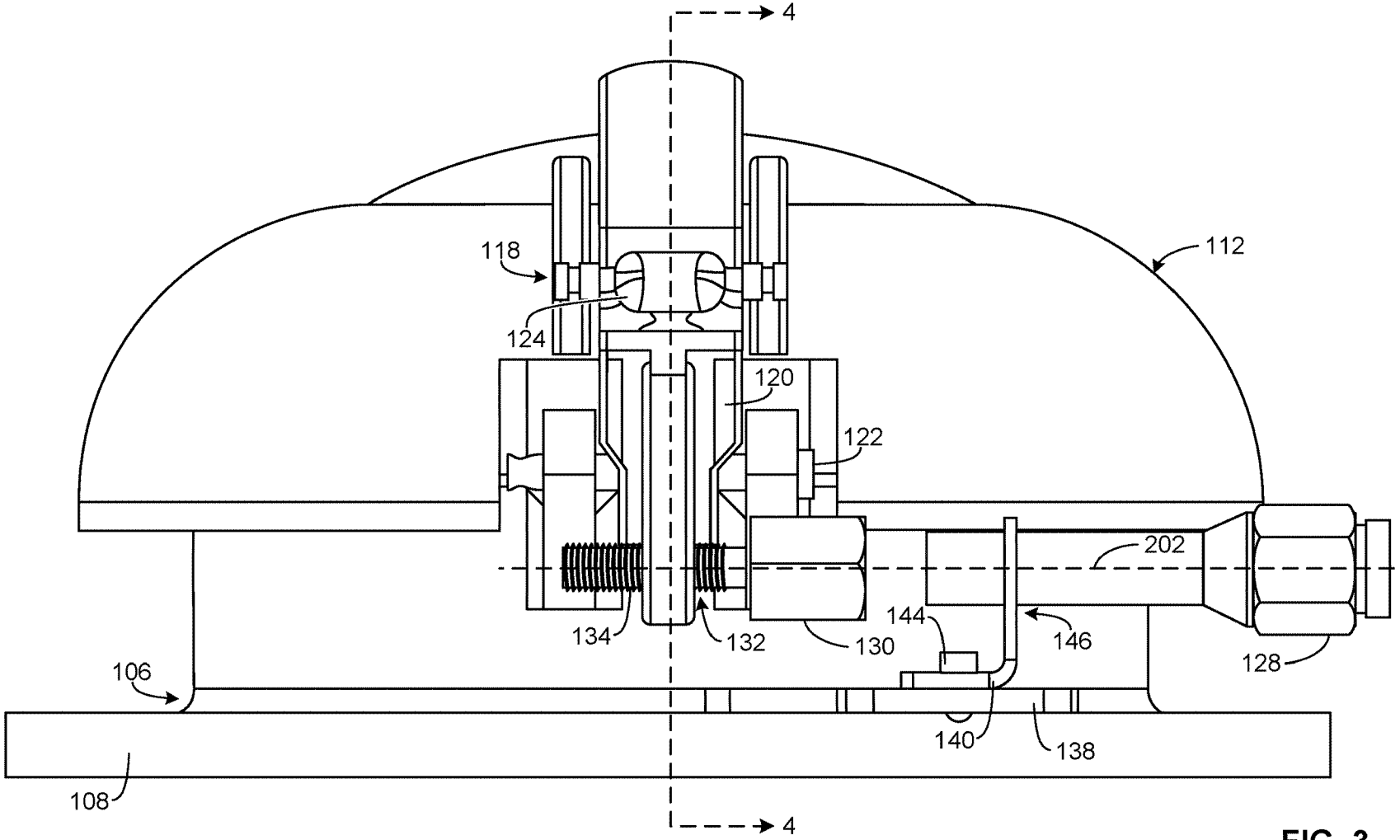
FIG. 3 is a side view of the example sensor that may be used to implement the example apparatus of FIG. 1.

FIGS. 2 and 3 are more detailed views of the example sensor 126 that may be used to implement the example apparatus 100 described herein. The example sensor 126 is coupled to the hatch 102 adjacent the latch 118. In the illustrated examples of FIGS. 2 and 3, the sensor 126 includes a proximity switch 128 triggered by a target 130. To trigger the switch 128, the target 130 must be in proximity to the switch 128. In the illustrated example, the target 130 is in proximity to the switch 128 when the target 130 is aligned with the switch 128 along a longitudinal axis 202 to trigger the switch 128. FIGS. 2 and 3 show different views of the switch 128 aligned with the target 130. The example switch 128 may be a single pole switch, and may be in an on or off position. For example, the switch 128 may be on when the target 130 is aligned with the switch 128, and may be off when the target 130 is not aligned with the switch 128. In some such examples, the alarm or alert sent to the operator workstation 150 may only be triggered when the switch 128 is off. Alternatively, the status of the switch 128 and, thus, the status of the hatch 102 is always available to the operator via the operator workstation 150. For example, if the switch 128 is on, an indicator on the operator workstation 150 corresponding to the hatch 102 may be green (e.g., on a map of a process control system that includes status indicators, on a list of components having status indicators, etc.). In some examples, when the switch 128 is off (e.g., when the hatch 102 is not properly closed), an alert may pop up on a screen of the operator workstation 150 to alert the operator of the status of the hatch 102, which may need to be remedied.

Figure 4:
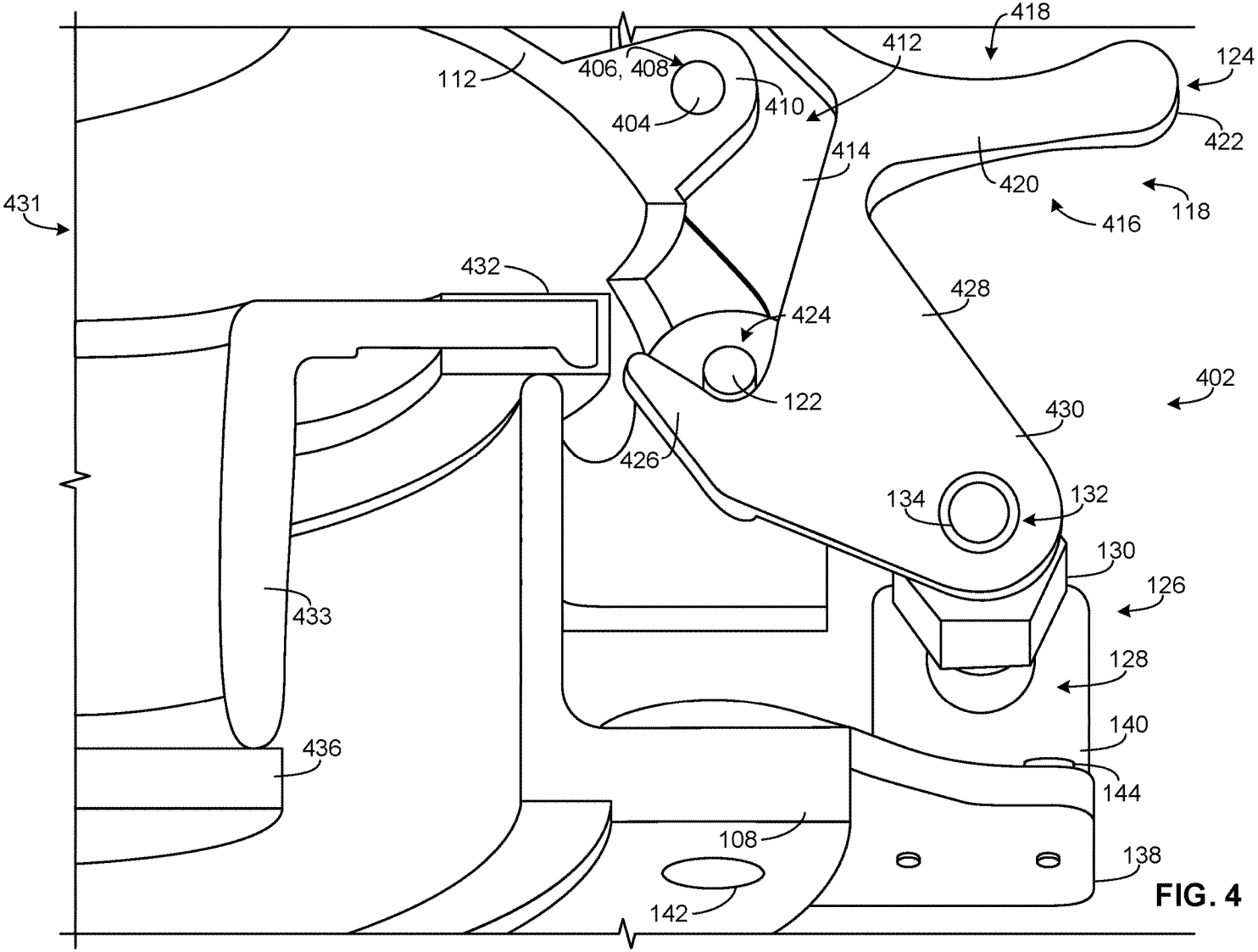
FIG. 4 is a detailed cross-sectional view of a latch of the example apparatus in a closed position taken along line 4-4 of FIG. 3.
Figure 5:
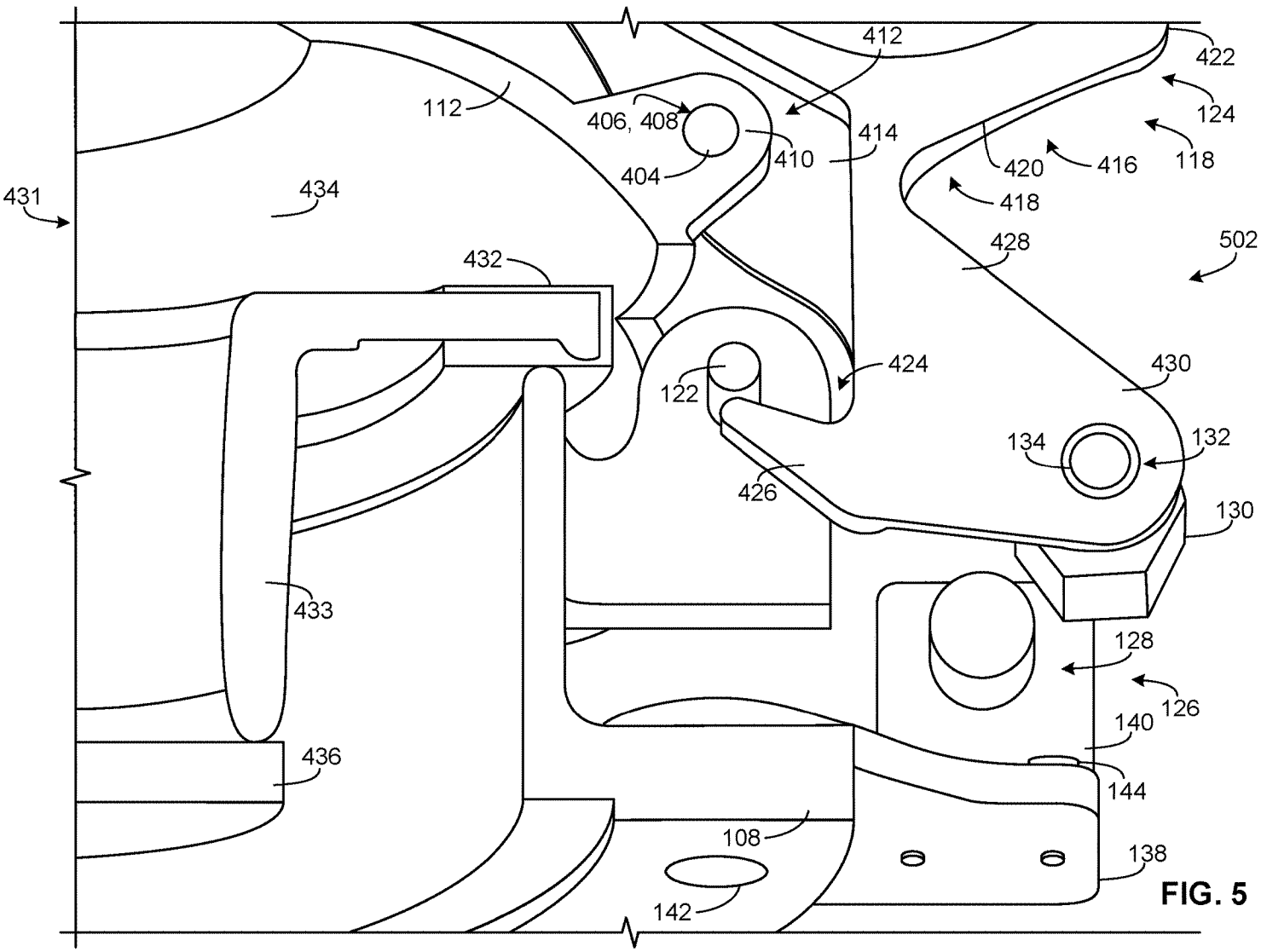
FIG. 5 is a detailed cross-sectional view of the latch similar to FIG. 4 but with the latch in an open position.

FIG. 4 is a detailed view of the example latch 118 of the example apparatus 100 in a closed position 402 (e.g., the latch is in a secured position) and FIG. 5 is a detailed view of the latch 118 in an open position 502. As shown in FIG.

4, when the latch 118 is properly closed (e.g., in a secured position), the example target 130 is aligned with the example switch 128 of the sensor 126, as described in conjunction with FIGS. 2 and 3. When the latch 118 is not properly closed (e.g., is open), as depicted in FIG. 5, the target 130 is not aligned with the switch 128, and the sensor 126 may send an alert to the operator workstation 150 via the transmitter 148.

The example latch 118 depicted in FIG. 4 may be operatively coupled to the hatch 102 via a fastener 404. The fastener 404 is disposed through the hook 120 and the lid 112 via corresponding aligned bores 406, 408 on the hook 120 and the lid 112. In some examples, the lid 112 may include one or more flanges 410 through which the bore(s) 406 are disposed. In examples where the lid 112 has one flange 410, the flange 410 may be positioned in a hollow portion 412 between flanges 414 of the latch 118. The bore(s) 408 of the hook 120 may be disposed on the flanges 414 adjacent an edge of the hook 120. The fastener 404 is disposed through the bores 406, 408 of the flanges 410, 414. The example fastener 404 is coupled to a top portion (e.g., an upper portion) of the hook 120. The fastener 404 may be a pin or any other type of fastener (e.g., a bolt, a rod, etc.) suitable to fasten the hook 120 to the lid 112. In some examples, the fastener 404 is integrally formed with the hook 120, and may be, for example, a detent or other protrusion of the flange 410 or the flanges 414. The example hook 120 is rotatable about the fastener 404 to move from the secured position 402 (e.g., a position in which the switch 128 and the target 130 are aligned) in FIG. 4 to the unsecured position 502 (e.g., a position in which the switch 128 and the target 130 are not aligned) in FIG. 5.

The example hook 120 further includes a handle 416 or hand grip positioned adjacent to the flanges 414. The example handle 416 may include a protrusion 418 having a neck portion 420 extending from the example hook 120. At an opposite end of the protrusion 418, the example handle 416 includes a knob 422 or grip area to facilitate a user gripping the handle 416 to secure and/or release the latch 118. In some examples, the knob 422 of the handle 416 may include a textured portion and/or a rubberized area to further facilitate the user gripping the handle 416.

The example hook 120 includes a seat 424 in which the catch 122 is seated when the latch 118 is properly closed. The seat 424 is formed by a protrusion 426 extending from an intermediate portion 428 of the latch 118 at an angle such that the seat 424 of the hook 120 accommodates the catch 122 to secure the latch 118 in the closed position 402. That is, the catch 122 cannot be removed from the seat 424 unless the user manipulates the latch 118, via the handle 416, to release the latch 118. In the illustrated example, the protrusion 426 extends from the hook 120 at an angle that is less than 90 degrees.

The example target 130 of the sensor 126 is coupled to a lower portion 430 (e.g., a bottom portion) of the hook 120. In other examples, the target 130 may be coupled to the top portion of the latch 118 or any other portion of the latch 118. The example target 130 of the sensor 126 is disposed through the bore 132 (e.g., a threaded bore) of the lower portion 430 of the hook 120. The example lower portion 430 of the hook 120 protrudes from the hook 120 to enable the target 130 of the sensor 126 disposed through the bore 132 of the hook 120 to align with the switch 128 of the sensor 126 coupled to the base 106 of the hatch 102 without interfering with the hatch 102 or the latch 118. Alternatively, in some examples, the target 130 of the sensor 126 may be coupled to the lid 112 of the hatch 102, separate from the latch 118. The example switch 128 of the sensor 126 may be coupled to the base 106 of the hatch 102 via the example bracket 136, or may be coupled to the base 106 using any other suitable bracket.

In the illustrated example, when the latch 118 is in the closed position 402 and the lid 112 is properly closed, a sealing assembly 431 coupled to the lid 112 of the hatch 102 is operative to seal the contents of the tank 104 relative to the atmosphere. The sealing assembly 431 includes a first seal 432 that is urged into sealing engagement with a rim of the base 106 of the hatch 102 by a spring (e.g., a biasing element). As the seal 432 is urged towards the base 106, an equal and opposite force urges the lid 112 away from the base 106. However, the lid 112 is prevented from opening when the latch 118 is in the closed position because the latch 118 is urged against the catch 122. In this manner, the hatch 102 may be closed and secured with a relatively tight seal to reduce or avoid leakage of fluid to an external environment. When a pressure of the tank 104 is too high, the seal 432 may temporarily release (e.g., unseal, break, etc.) as the force of the spring 434 is overcome to regulate the pressure of the tank 104 while the lid 112 is closed and the latch 118 is properly secured to the catch 122. In some examples, a separate spring or other biasing element on the seal assembly 431 urges a second seal 436 into sealing engagement with the center body 433 of the seal assembly 431. When a pressure of the tank 104 drops too low, the second seal 436 may temporarily release (e.g., unseal, break, etc.) as the force of a biasing element (e.g., a vacuum spring) is overcome to again regulate the pressure of the tank 104. To release the spring force from the first spring 434 to unlatch the latch 118, a user or operator may apply a force to the top of the lid 112 by, for example, pushing down on the lid 112. When the spring 434 is compressed and the spring force is no longer urging the hook 120 into engagement with the catch 122, the user may use the handle 416 of the latch 118 to release the latch 118 and open the lid 112 of the hatch 102.

From the foregoing, it will be appreciated that the above disclosed methods, apparatus and articles of manufacture describe an apparatus to wirelessly monitor a status of a hatch on a tank. The example apparatus and articles of manufacture described herein may be implemented on a new hatch, or may be retrofitted to an existing hatch.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a hatch to be coupled to a fluid tank;

a latch to secure the hatch in a closed position;

a bracket removably couplable to a base of the hatch; and a sensor to detect whether the latch is securing the hatch in the closed position, the sensor having a first portion coupled to a lid of the hatch and a second portion coupled to the bracket.

2. The apparatus as defined in claim 1, wherein when the latch is securing the hatch in the closed position, the first and second portions of the sensor are aligned.

3. The apparatus as defined in claim 1, wherein when the latch is not securing the hatch in the closed position, the first and second portions of the sensor are misaligned.

4. The apparatus as defined in claim 1, further including a transmitter operatively coupled to the sensor, the transmitter to send a signal to an operator based on an output from the sensor.

5. The apparatus as defined in claim 4, wherein the transmitter is a wireless transmitter operative to wirelessly communicate with an operator workstation.

6. The apparatus as defined in claim 1, wherein the sensor is a proximity sensor, a magnetic switch, an optical sensor, a limit switch, or an acoustic sensor.

7. An apparatus comprising:

means for securing a means for closing a hatch of a tank;

a bracket removably couplable to a base of the hatch; and means for detecting a position of the means for securing, the means for detecting including a first portion coupled to the means for closing and a second portion coupled to the bracket.

8. The apparatus as defined in claim 7, further including means for communicating the position.

9. The apparatus as defined in claim 8, wherein the means for communicating wirelessly communicates the position to means for monitoring the means for securing.

10. The apparatus as defined in claim 9, wherein the means for communicating sends an alert to the means for monitoring when the means for securing is in an open position.

11. The apparatus as defined in claim 7, wherein the means for securing is in a closed position when the first portion and the second portion of the means for detecting are in proximity to each other.

12. The apparatus as defined in claim 11, wherein the means for securing is in an open position when the first portion and the second portion of the means for detecting are not in proximity to each other.

13. An apparatus comprising:

a hook to engage a catch of a hatch on a tank;

a first portion of a sensor to be coupled to the hook;

an adapter plate removably couplable to a base portion of the hatch adjacent the hook; and a second portion of the sensor to be coupled to the adapter plate, the first and second portions of the sensor to cooperate to detect when the hook is engaged with the catch.

14. The apparatus as defined in claim 13, wherein the first portion of the sensor is a target magnet.

15. The apparatus as defined in claim 13, wherein the second portion of the sensor is a magnetic switch.

16. The apparatus as defined in claim 13, wherein first and second portions of the sensor detect when the hook is engaged with the catch based on when the first portion is in proximity with the second portion such that the second portion detects the first portion.

17. The apparatus as defined in claim 16, wherein the hook is to be coupled to a movable portion of the hatch and the catch is to be coupled to the base portion of the hatch.

18. The apparatus as defined in claim 17, wherein the hook is to replace a latch provided with the hatch on the movable portion.

19. The apparatus as defined in claim 13, wherein the adapter plate is to removably attach to a flange of the base portion used to attach the hatch to the tank.

20. The apparatus of claim 2, wherein the first portion and the second portion are aligned along a longitudinal axis of the second portion.

21. The apparatus of claim 20, wherein the longitudinal axis extends substantially parallel to a plane defined by a flange of the base used to attach the hatch to the tank.

22. The apparatus of claim 20, wherein the first portion is to extend in a direction substantially transverse to a line extending between the latch and a hinge coupling the lid to the base.

* * * * *